US007988000B2

(12) United States Patent
Clark et al.

(10) Patent No.: US 7,988,000 B2
(45) **Date of Patent: *Aug. 2, 2011**

(54) DISPLAY FIXTURE ACCESSORIES

(75) Inventors: Jeremy A. Clark, Minneapolis, MN (US); Michael A. Whittier, Minneapolis, MN (US); John Thomas, Eden Prairie, MN (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/874,542

(22) Filed: Sep. 2, 2010

(65) Prior Publication Data

US 2010/0326931 A1 Dec. 30, 2010

Related U.S. Application Data

(62) Division of application No. 11/627,262, filed on Jan. 25, 2007, now Pat. No. 7,810,658.

(60) Provisional application No. 60/762,391, filed on Jan. 26, 2006.

(51) Int. Cl.
*A47B 47/00* (2006.01)

(52) U.S. Cl. ..... 211/189

(58) Field of Classification Search ..... 211/189, 211/190, 103, 207, 187; 248/447.1, 469
See application file for complete search history.

(56) References Cited

U.S. PATENT DOCUMENTS 1,541,200 A 6/1925 Thomson
1,804,770 A 5/1931 Hershfield
1,837,348 A 12/1931 Ware
1,857,423 A 5/1932 Zadek
1,934,533 A 11/1933 Hallowell et al.
2,436,273 A 2/1948 Solomon
2,710,241 A 6/1955 Lieberman
2,791,851 A 5/1957 Richter
2,798,618 A 7/1957 Singer
2,893,568 A 7/1959 Scholz
2,932,771 A 4/1960 Craven, Jr.
3,087,186 A 4/1963 Budd
3,219,300 A 11/1965 Gunderson
3,297,374 A 1/1967 Radek
3,326,505 A 6/1967 Jamar, Jr.
3,402,906 A 9/1968 Wellman (Continued)

OTHER PUBLICATIONS

Clark, Jeremy A. et al., Product Display, U.S. Appl. No. 29/278,881, filed Apr. 12, 2007.

(Continued)

*Primary Examiner* — Sarah Purol
(74) *Attorney, Agent, or Firm* — Griffiths & Seaton PLLC

(57) ABSTRACT

A merchandising system includes a display fixture placed on a floor in a retail environment. The display fixture includes a first end piece resting supported on the floor, a second end piece supported on the floor, a first member, and a second member, each of the first member and the second member being substantially horizontal with the second member extending substantially parallel to, and vertically offset from the first member. A display fixture accessory is releasably secured to the display fixture by receiving the first member in a first bracket of the display fixture accessory and receiving the second member in a second bracket of the display fixture accessory. A display piece is inserted into the display fixture accessory. Additionally, the display piece is maintained with the display fixture accessory in a substantially vertical position with the display fixture accessory extending above the display fixture.

20 Claims, 15 Drawing Sheets

U.S. PATENT DOCUMENTS

| | | | |
|---|---|---|---|
| 3,411,634 | A | 11/1968 | Pesce |
| 3,415,519 | A | 12/1968 | Hand |
| 3,529,798 | A | 9/1970 | Williams et al. |
| 3,601,256 | A | 8/1971 | Bowers et al. |
| 3,737,048 | A | 6/1973 | Giroux |
| 3,792,917 | A | 2/1974 | Martinez |
| 3,830,374 | A | 8/1974 | Kassimir |
| 3,856,320 | A | 12/1974 | Blanchard |
| 3,865,250 | A | 2/1975 | Jay |
| 4,046,083 | A | 9/1977 | Murdoch et al. |
| 4,127,196 | A | 11/1978 | Boucher |
| 4,138,083 | A | 2/1979 | Spiegel |
| 4,191,298 | A | 3/1980 | Broudy |
| 4,331,245 | A | 5/1982 | Schell |
| 4,380,298 | A | 4/1983 | Harig |
| 4,431,156 | A | 2/1984 | Mena |
| 4,444,322 | A | 4/1984 | Lee |
| 4,452,416 | A | 6/1984 | Templeton |
| 4,460,097 | A | 7/1984 | Darnell et al. |
| 4,473,963 | A | 10/1984 | Hardy et al. |
| 4,716,841 | A | 1/1988 | Suttles |
| 4,925,038 | A | 5/1990 | Gajewski |
| 4,993,680 | A | 2/1991 | Gemmen et al. |
| D318,194 | S | 7/1991 | Terrell et al. |
| D319,934 | S | 9/1991 | Terrell et al. |
| 5,124,858 | A | 6/1992 | Goetz |
| 5,272,991 | A | 12/1993 | Carrigan, Jr. |
| 5,433,046 | A | 7/1995 | MacQuarrie et al. |
| D371,026 | S | 6/1996 | Hendler et al. |
| 5,535,898 | A | 7/1996 | Burgess, Sr. et al. |
| 5,607,070 | A | 3/1997 | Hellyer |
| 5,611,442 | A | 3/1997 | Howard |
| 5,653,349 | A | 8/1997 | Dana et al. |
| 5,660,637 | A | 8/1997 | Dodge |
| D394,360 | S | 5/1998 | Geier et al. |
| D409,858 | S | 5/1999 | Reed |
| 5,915,656 | A | 6/1999 | Grewe |
| 5,918,750 | A | 7/1999 | Jackson |
| 5,921,190 | A | 7/1999 | Wood |
| 5,944,203 | A | 8/1999 | Vlah et al. |
| 5,971,343 | A | 10/1999 | Marlak |
| D417,978 | S | 12/1999 | Reed |
| 6,029,833 | A | 2/2000 | Yeh |
| 6,053,115 | A | 4/2000 | Felton |
| D427,457 | S | 7/2000 | Heiny et al. |
| 6,298,591 | B1 | 10/2001 | Healy |
| D450,948 | S | 11/2001 | Stafford et al. |
| D451,300 | S | 12/2001 | Stafford et al. |
| 6,427,855 | B2 | 8/2002 | LaBruna, Jr. et al. |
| D466,331 | S | 12/2002 | Chang |
| 6,488,160 | B2 | 12/2002 | Wang |
| 6,503,188 | B1 | 1/2003 | August |
| D470,685 | S | 2/2003 | Chang |
| D474,350 | S | 5/2003 | Sardis |
| 6,561,365 | B2 | 5/2003 | Bustos |
| 6,561,366 | B2 | 5/2003 | Kim-So |
| 6,669,037 | B1 | 12/2003 | Ahn |
| D495,523 | S | 9/2004 | Harwanko |
| 6,786,340 | B2 | 9/2004 | Ford et al. |
| 6,935,523 | B2 | 8/2005 | Ahn |
| 6,959,824 | B1 | 11/2005 | Alperson |
| D533,738 | S | 12/2006 | Berg et al. |
| D554,919 | S | 11/2007 | Clark et al. |
| 7,810,658 | B2 * | 10/2010 | Clark et al. ..... 211/189 |

OTHER PUBLICATIONS

Clark, Jeremy A. et al., Product Display, U.S. Appl. No. 29/278,883, filed Apr. 12, 2007.

* cited by examiner

DISPLAY FIXTURE ACCESSORIES

CROSS-REFERENCES TO RELATED APPLICATIONS

This application is a divisional of U.S. patent application Ser. No. 11/627,262, filed Jan. 25, 2007, now U.S. Pat. No. 7,810,658, which claims the benefit of U.S. Provisional Patent Application Ser. No. 60/762,391, filed Jan. 26, 2006, the entire contents of each of which are hereby incorporated by reference in this application.

This application is related to U.S. Des. Pat. App. Ser. No. 29/252,756, filed on Jan. 26, 2006 and entitled PRODUCT DISPLAY, now U.S. Design Pat. No. D554,919, the contents of which are incorporated herein by reference.

BACKGROUND

Display fixtures are often used to support and display merchandise in a retail environment. Display fixtures that are eye-catching, fun, interesting, or otherwise visually effective help promote retail sales. Often times, display space is at a premium, which drives a need for efficient use of such space in retail or other environments. As such, it is desirable to provide display fixtures characterized as space efficient, visually pleasing, and accessible. While traditional, basic display fixtures accomplish these features to some extent, enhancements in the functionality, or overall merchandising effect, of such display fixtures remain to be realized.

SUMMARY

Some aspects relate to a method of assembling a merchandising system. The method includes placing a display fixture on a floor in a retail environment. The display fixture includes a first end piece resting supported on the floor, a second end piece supported on the floor, a first member, and a second member, each of the first member and the second member being substantially horizontal with the second member extending substantially parallel to, and vertically offset from the first member. A display fixture accessory is releasably secured to the display fixture by receiving the first member in a first bracket of the display fixture accessory and receiving the second member in a second bracket of the display fixture accessory. A display piece is inserted into the display fixture accessory. Additionally, the display piece is maintained with the display fixture accessory in a substantially vertical position with the display fixture accessory extending above the display fixture.

While some aspects of the invention have been described above, other related products and methods are also disclosed and provide additional advantages.

BRIEF DESCRIPTION OF THE DRAWINGS

Embodiments are described in the Detailed Description with respect to the figures, in which like reference numbers denote like elements, and in which.

DETAILED DESCRIPTION

In the following detailed description, reference is made to the accompanying drawings, which form a part hereof, and in which is shown by way of illustration specific embodiments in which the invention may be practiced. In this regard, directional terminology, such as "top," "bottom," "front," "back," "left," "right," etc., is used with reference to the orientation of the Figure(s) being described. Because components of the embodiment display systems can be positioned in a number of different orientations, the directional terminology is used for the purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
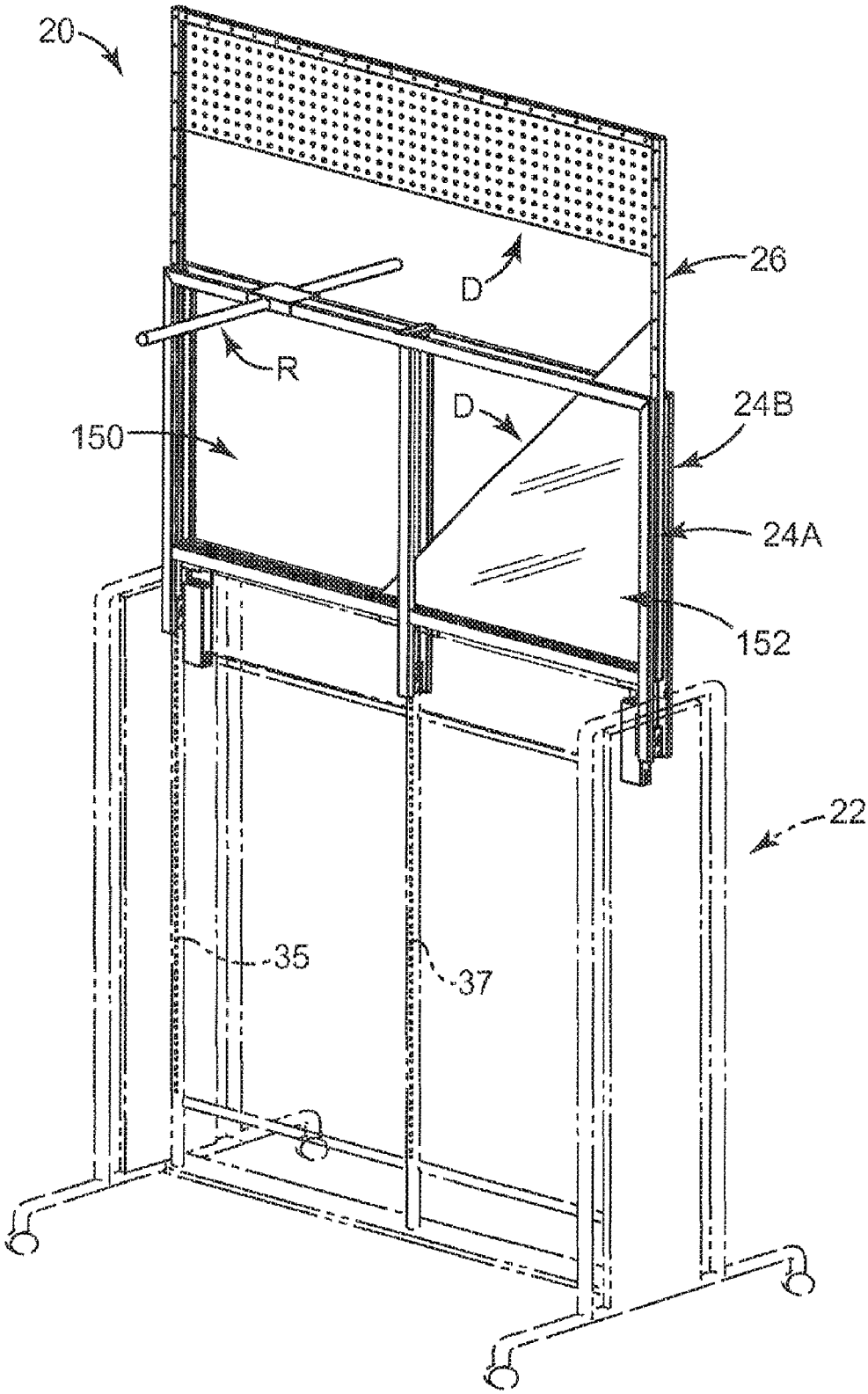
FIGS. 1-3 show various configurations of a display system, according to some embodiments.

FIG. 1 shows a display system 20, also described as a racking system, a merchandising system, a rack fixture assembly, or a merchandising display. Generally speaking, the display system 20 includes a convertible fixture 22 (shown in dotted lines in FIG. 1 to assist in understanding), a first merchandise extender 24A, a second merchandise extender 24B, and/or a billboard attachment 26. In general terms, first and second merchandise extenders 24A, 24B, the billboard attachment 26, and associated structures, are "accessories" to a display fixture, such as the convertible fixture 22. For reference, the convertible fixture 22 is also described as a base rack, a base fixture, or a display fixture. In turn, the merchandise extenders 24A, 24B are also described as racking extensions or frame extensions. The billboard attachment 26 is also described as an attachable frame, a display device chassis, or a billboard extender.

For reference, the merchandise extenders 24A, 24B and the billboard attachment 26 are generally formed of metal, such as aluminum or steel, or appropriate plastics. However, a variety of other materials are optionally used. In general terms, the convertible fixture 22, the merchandise extenders 24A, 24B, and the billboard attachment 26 are each optionally configured to support one or more merchandise support pieces R, such as racking components, shelves, hangers, hooks, and others, and/or one or more display pieces D, such as billboards, posters, pictures, pegboards (which, in turn, are optionally used to support merchandising support pieces R). The display system 20 is optionally used in a retail environment to merchandise soft-lines, or clothing, and/or hard-lines as desired.

For reference, one or both of the merchandise extenders 24A, 24B and the billboard attachment 26 are optionally attached to the convertible fixture 22 to facilitate use of various display pieces D, such as product billboards or other merchandising signage, and/or to increase a merchandise carrying and displaying capacity of the rack fixture 22, for example by providing additional space for shelves, hangers, pegboard material, and others. As will be described in greater detail, the billboard attachment 26 and/or first and second merchandise extenders 24A, 24B are optionally assembled to the convertible fixture 22 such that they extend vertically above the convertible fixture 22.

Figure 2:
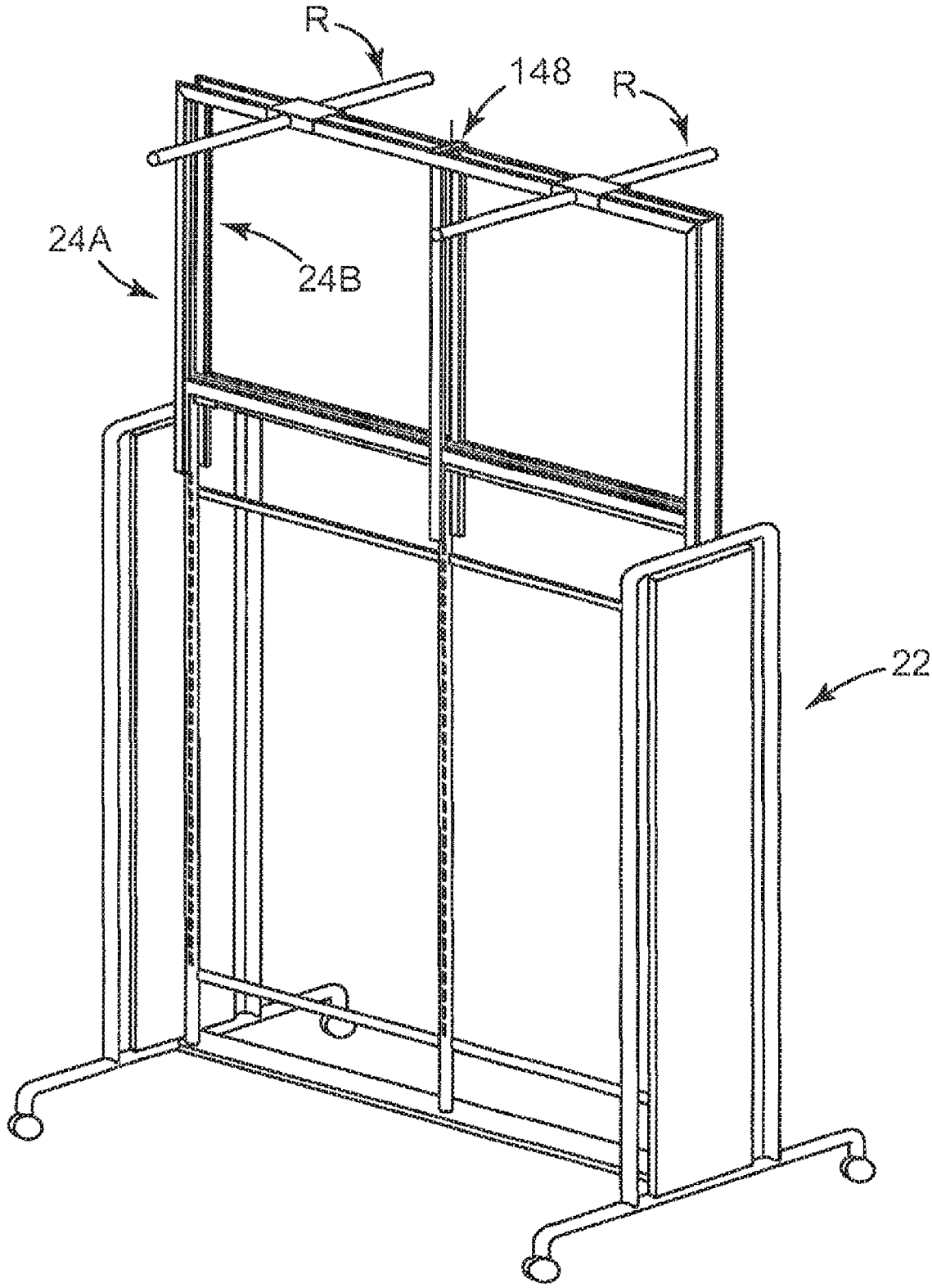

With reference to FIG. 2, one or both merchandise extenders 24A, 24B are optionally used with the convertible fixture 22 without the billboard attachment 26. As alluded to above, a single one of the merchandise extenders 24A, 24B is used if desired. In turn, and with reference to FIG. 3, the billboard attachment 26 is optionally assembled to the convertible fixture 22 without one or both of the merchandise extenders 24A, 24B.

Figure 4:
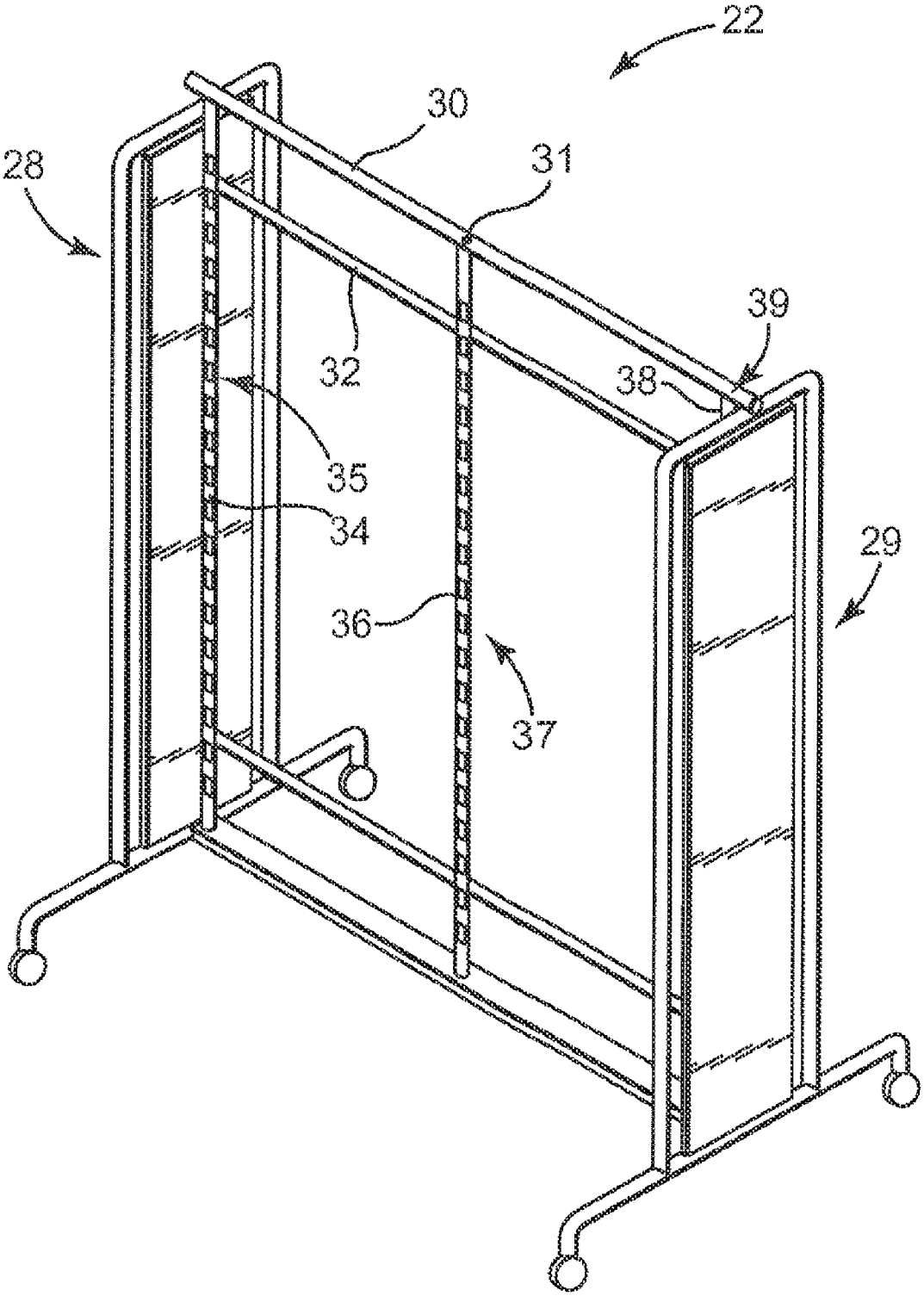
FIG. 4 is a perspective view of a convertible fixture, according to some embodiments.

FIG. 4 is a perspective view of the convertible fixture 22. The convertible fixture 22 includes a first end piece 28, a second end piece 29, an upper horizontal member 30, an intermediate horizontal member 32, a first outer member 34, a central member 36, and a second outer member 38 (partially obscured in FIG. 4). The first and second end pieces 28, 29 are opposingly positioned, on opposite ends, and are adapted to support the convertible fixture 22 on a substantially horizontal surface (not shown). Each of the upper horizontal member 30, the first outer member 34, the central member 36, and the second outer member 38 is optionally substantially tubular in shape, for example having a substantially round transverse cross-section. However, other cross-sections, for example, rectangular, are also contemplated. The intermediate horizontal member 32 is substantially rectangular in transverse cross-section, and is otherwise described as an elongate band, or strip of material. However, other shapes for the intermediate horizontal member 32 are contemplated, such as a substantially circular shape, for example.

The upper and intermediate horizontal members 30, 32 span the first outer member 34 and the second outer member 38 to the first and second end pieces 28, 29. The upper horizontal member 30, also described as a first horizontal member, optionally includes a locator pin hole 31 centrally located on the upper horizontal member 30. The first outer member 34 defines a plurality of slots 35 that are optionally substantially rectangular in shape. Each of the plurality of slots 35 is adapted to receive projections or other fastening means (not shown) for releasably securing hangers, hooks, shelves, or other display means to the convertible fixture 22, as desired. The central member 36 and the second outer member 38 each include a plurality of slots 37, 39, respectively (slots 39 are partially obscured in FIG. 4). The pluralities of slots 37, 39 are each optionally substantially similar to the plurality of slots 35 of the first outer member 34. Although not shown, the members 34, 36, 38 also each optionally have pluralities of slots on opposite sides of the members 34.

Figure 5:
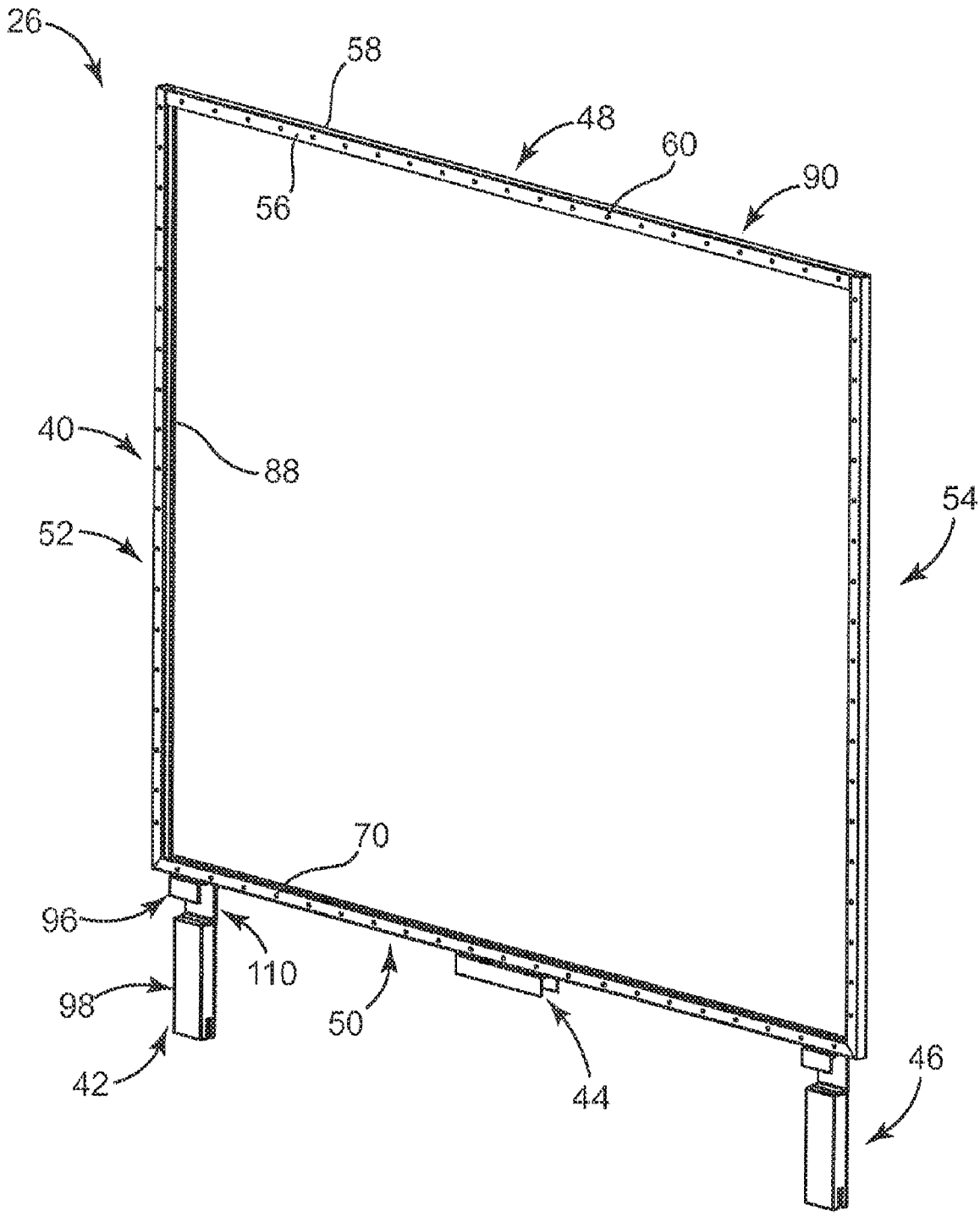
FIG. 5 is a perspective view of a billboard attachment, according to some embodiments.

FIG. 5 is a perspective view of the billboard attachment 26. The billboard attachment 26 includes a frame 40, a first bracket assembly 42, or first clip, a central bracket assembly 44, and a second bracket assembly 46, or second clip. The frame 40 is optionally substantially rectangular in shape and includes a top side 48, a bottom side 50, a first side 52, and a second side 54. The top side 48 includes a front band 56 and a back band 58 (largely obscured by the front band 56 in FIG. 5).

The front and back bands 56, 58, are optionally substantially similar, mirror images of one another. As such, the back band 58 is described cumulatively with reference to the front band 56. The front band 56 is substantially rectangular in transverse cross-section, having a relatively thin and substantially elongate body. The front band 56 includes a plurality of spaced-apart holes 60 through a thickness of the front band 56. The plurality of spaced-apart holes 60 are optionally adapted to receive pins, fasteners, or other devices for securing one or more billboards, merchandising signage, pegboards, or other display pieces D to the frame 40.

Figure 6A:
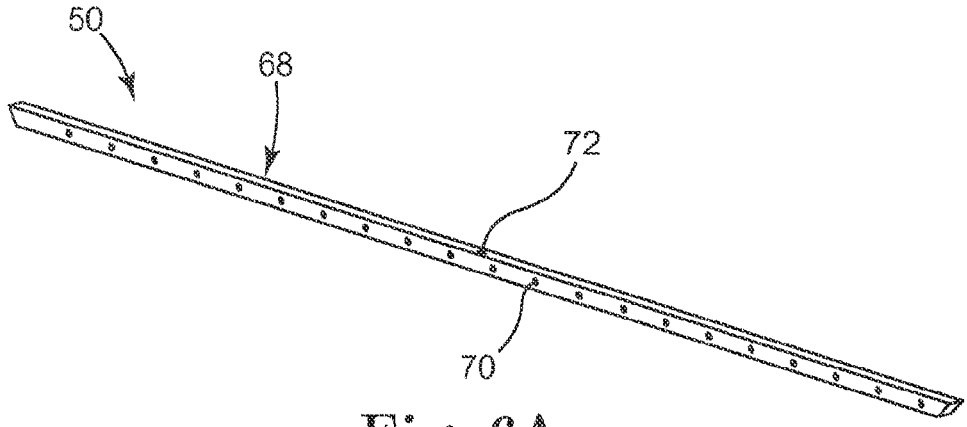
FIGS. 6A and 6B are perspective and end views, respectively, of a portion of the billboard attachment of FIG. 5, according to some embodiments.
Figure 6B:
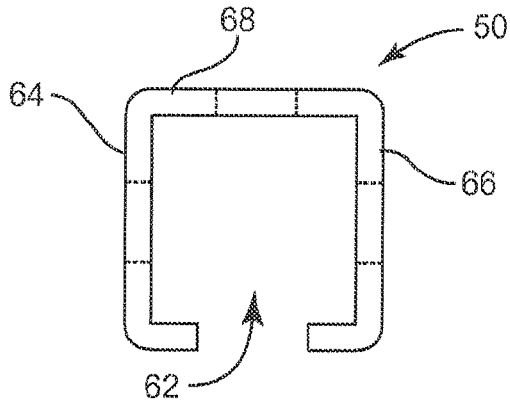

FIGS. 6A and 6B show the bottom side 50 of the frame 40 from perspective and end views, respectively. With reference to FIGS. 6A and 6B, the bottom side 50 is substantially C-shaped in transverse cross-section and substantially elongate, defining a channel 62 extending lengthwise along the bottom side 50. The bottom side 50 includes a front wall 64, a back wall 66, and a bottom wall 68. The bottom side 50 also has a plurality of spaced-apart holes 70 extending through both the front wall 64 and the back wall 66 and a locator pin hole 72 positioned centrally on, and extended through, the bottom wall 68.

Figure 7A:
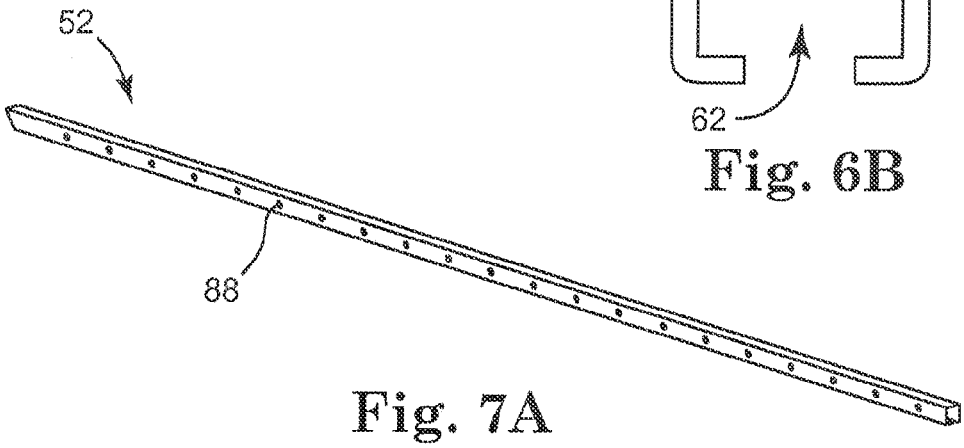
FIGS. 7A and 7B are perspective and end views, respectively, of a portion of the billboard attachment of FIG. 5, according to some embodiments.
Figure 7B:
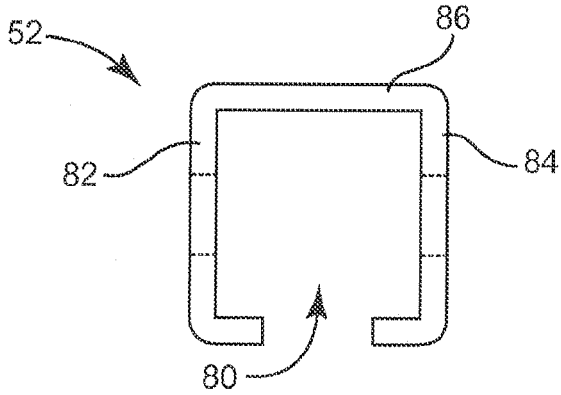

FIGS. 7A and 7B illustrate perspective and end views of the first side 52, respectively. The first and second sides 52, 54 are optionally substantially similar, and as such are described cumulatively with respect to the first side 52. With reference to FIGS. 7A and 7B, the first side 52 is optionally formed as a substantially hollow, tubular member and defines a substantially C-shaped transverse cross-section with a channel 80 extending lengthwise along the first side 52. The first side 52 also defines a front wall 82, a back wall 84, and a side wall 86. If desired, a plurality of spaced-apart holes 88 is optionally formed through both of the front and back walls 82, 84.

With reference to FIG. 5, the top side 48, the bottom side 50, the first side 52, and the second side 54 are optionally assembled in a substantially rectangular configuration, for example, by welding. The channel 62 (FIG. 6B) of the bottom side 50, the channel 80 (FIG. 7B) of the first side 52, and a channel (not shown) of the second side 54 are all optionally aligned to one another. Additionally, the front band 56 and the back band 58 of the top side 48 are optionally arranged in a substantially parallel, symmetrical, and spaced-apart fashion to define a top channel 90 (FIG. 5) between the front and back bands 56, 58.

In this manner, the frame 40 is optionally configured to receive a display piece D (FIG. 1), such as a billboard, pegboard, poster, picture, or other display piece D, between the front and back bands 56, 58, through the channel 90, and into the channel 62 formed by the first side 52 and the channel formed by the second side 54. If sufficiently long, or if positioned toward the bottom side 50, the display piece D is also optionally received in the channel 62 of the bottom side 50. For example, while a particular display piece D is optionally sized to substantially fill the frame 40, smaller designs are also contemplated. As shown in FIG. 1, the display piece or pieces D optionally fill only a portion of the frame 40. Such versatility is facilitated by incorporation of the various channels around the frame 40 and an ability to secure the display piece to portions of the frame 40 using one or more of the pluralities of spaced-apart holes 60, 70, 88. For example, suitable clips or inserts are optionally inserted into one or more of the pluralities of spaced-apart holes 60, 70, 88 to secure one or more display pieces D to the frame 40.

With reference to FIG. 5, the first bracket assembly 42 and the second bracket assembly 46 are optionally substantially similar, and thus are described cumulatively with reference to the first bracket assembly 42. In particular, the first bracket assembly 42 includes an upper portion 96 and a lower portion 98.

Figure 8:
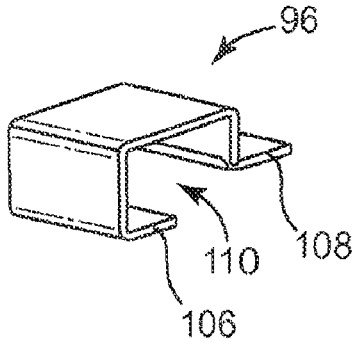
FIGS. 8 and 9 are perspective views of bracket assembly components of the billboard attachment of FIG. 5, according to some embodiments.

FIG. 8 shows the upper portion 96 of the first bracket assembly 42 from a perspective view. The upper portion 96 includes a retaining lip 106, a lower tab 108, and an L-shaped mouth 110, also described as a slot or receptacle. In general terms, the retaining lip 106 and the mouth 110 are configured to receive and secure the first bracket assembly 42 to the upper horizontal member 30 (FIG. 3) of the convertible fixture 22. In turn, the lower tab 108 is adapted to be secured to the lower portion 98 of the first bracket assembly 42.

Figure 9:
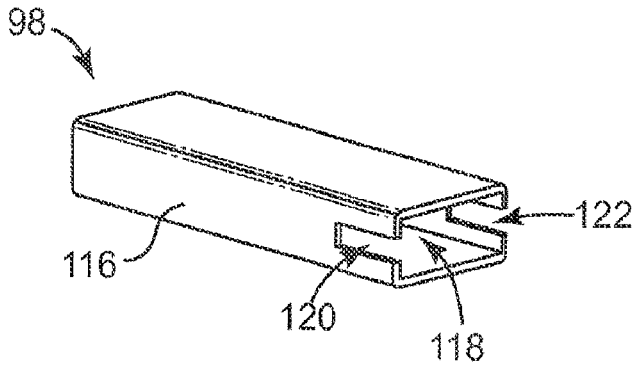

FIG. 9 illustrates the lower portion 98 of the first bracket assembly 42 from a perspective view. The lower portion 98 includes a hollow, tubular body 116 extending to a distal end 118. The lower portion 98 has a first slot 120, or receptacle, and a second slot 122, or receptacle. The two slots 120, 122 each extend from the distal end 118 of the body 116 longitudinally up the lower portion 98 on opposing sides of the body 116. In particular, the first and second slots 120, 122 are optionally adapted to receive a portion of the intermediate horizontal member 32 of the convertible fixture 22. The upper and lower portions 96, 98 are assembled together lengthwise with the lower tab 108 of the upper portion 96 secured to the body 116 of the lower portion 98, for example, by welding.

Figure 10:
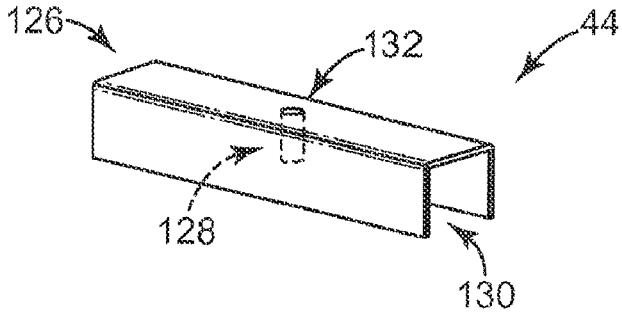
FIG. 10 is a perspective view of a central bracket assembly of the billboard attachment of FIG. 5, according to some embodiments.

FIG. 10 illustrates the central bracket assembly 44 from a perspective view. The central bracket assembly 44 includes a channel bracket and a locator pin 128 (shown in dotted lines). The channel bracket 126 is substantially U-shaped in transverse cross-section and defines a mouth 130, or receptacle, configured to receive the upper horizontal member 30 of the convertible fixture 22. The central bracket assembly 44 also optionally has a locator pin hole 132 located centrally along and extending through the channel bracket 126. The locator pin hole 132 is configured to coaxially receive the locator pin 128.

The locator pin 128 is optionally substantially cylindrical in shape, having a circular transverse cross-section. The locator pin 128 is about 5/16 inches in diameter, and about 1 and 1/16 inches long, for example, although other dimensions are contemplated. The locator pin 128 is adapted to be coaxially received in the locator pin hole 132 of the central bracket assembly 44, the locator pin hole 72 of the bottom side 50 of the frame 40, as well as the locator pin hole 31 formed in the upper horizontal member 30 of the convertible fixture 22.

FIG. 5 shows the billboard attachment 26 in an assembled form from a perspective view. As shown, the first bracket assembly 42, the central bracket assembly 44, and the second bracket assembly 46 are each secured to the bottom side 50 of the frame 40. The first bracket assembly 42 is secured proximate the first side 52 of the frame 40, for example, by welding the upper portion 96 of the first bracket assembly 42 to the bottom side 50 of the frame 40. For reference, the mouth 110 of the first bracket assembly 95 is facing outward with the first and second slots 120, 122 (FIG. 9) facing downward. The second bracket assembly 46 is similarly attached to the frame 40 proximate the second side 54 of the frame 40. The central bracket assembly 44 is attached to the bottom side 50 of the frame 40 in a centrally located position with the mouth 130 (FIG. 10) of the central bracket assembly 44 facing downward. In this manner, the locator pin 128 (FIG. 10) extends downwardly in the mouth 130 of the channel bracket 126. As referenced above, the respective components are optionally secured relative to one another using a variety of methods, for example, via welding.

With reference between FIGS. 4 and 5, one method of assembling the billboard attachment 26 to the convertible fixture 22 of the display system 20 includes aligning the locator pin 128 (FIG. 10) to the locator pin hole 31 of the convertible fixture 22. The locator pin 128 is coaxially inserted into the locator pin hole 31 and the upper horizontal member 30 is received within the mouth 110 of the first bracket assembly 42, the mouth 130 of the central bracket assembly 44, and in a mouth of the second bracket assembly 46. Additionally, the first and second slots 120, 122 of the first bracket assembly 42 are guided over the intermediate horizontal member 32. Similarly, first and second slots of the second bracket assembly 46 are slid, and guided onto the intermediate horizontal member 32. As the billboard attachment 26 is guided downward onto the convertible fixture 22, the intermediate horizontal member 32 is further received into the L-shaped mouth 110 of the first bracket assembly 42 and L-shaped mouth of the second bracket assemblies 44 until the retaining lip 106 (FIG. 8) of the first bracket assembly 42 and a retaining lip of the second bracket assembly 46 slide in front of the upper horizontal member 30 of the convertible fixture 22 to assist in maintaining the billboard attachment 26 on the convertible fixture 22 and in a substantially vertical position. From this, it should be understood that the billboard attachment 26 is maintained by the convertible fixture with a stable, yet releasable connection.

Figure 11:
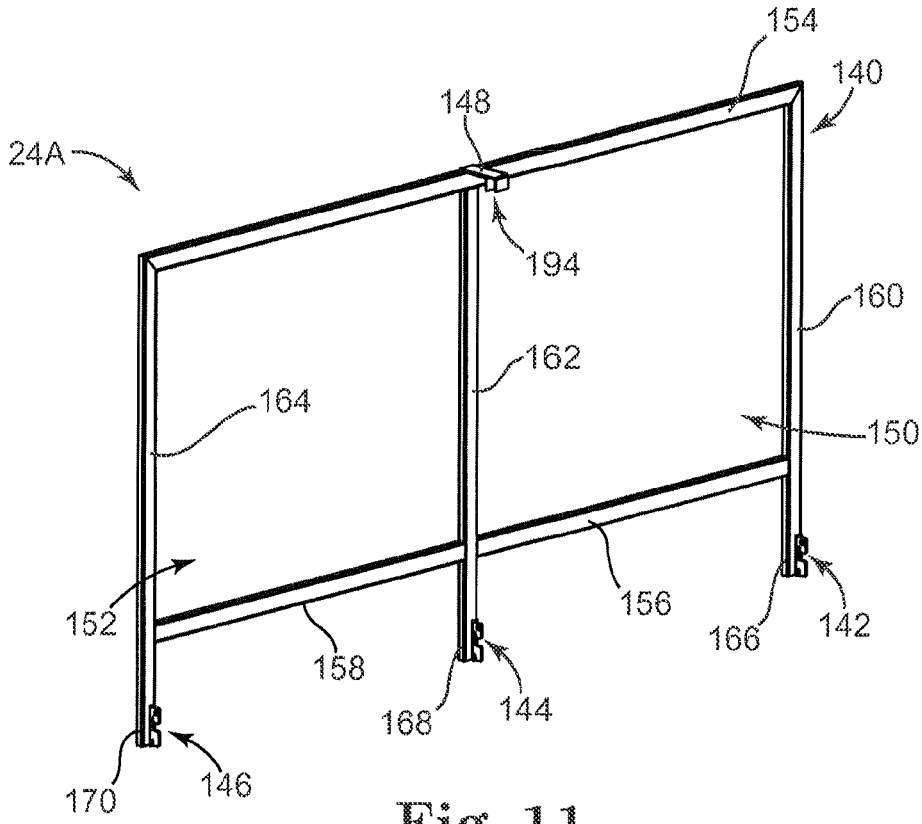
FIGS. 11 and 12 are perspective views of first and second merchandise extenders, according to some embodiments.
Figure 12:
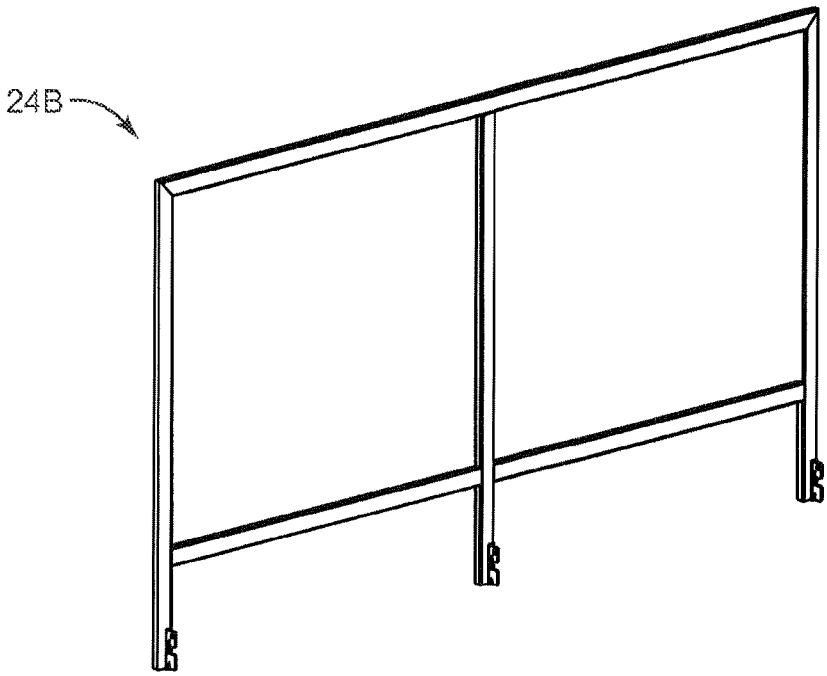

FIG. 11 shows the first merchandise extender 24A from a perspective view. FIG. 12 shows an embodiment of the second merchandise extender 24B from a perspective view. The first and second merchandise extenders 24A, 24B are optionally substantially similar. As such, the second merchandise extender 24B is generally described cumulatively with reference to the first merchandise extender 24A.

With reference to FIG. 11, the first merchandise extender 24A includes a frame 140, a first side vertical bracket 142, a central vertical bracket 144, a second side vertical bracket 146, and a lateral bracket 148 (note that the second merchandise extender 24B is free of a corresponding lateral bracket according to some embodiments). The frame 140 optionally defines a first window 150 and a second window 152, each of the two windows 150, 152 being substantially square or rectangular as desired. The frame 140 includes a top cross member 154, a first middle cross member 156, a second middle cross member 158, a first side member 160, a central member 162, and a second side member 164. Each of the first side member 160, the central member 162, and the second side member 164 defines distal portions 166, 168, 170, respectively.

As shown, the frame 140 is substantially rectangular in shape with the distal portions 166, 168, 170 extending downwardly relative to a remainder of the frame 140, although other shapes are contemplated. Respective components of the frame 140 are assembled via welding, for example. The top cross member 154, the first middle cross member 156, the second middle cross member 158, the first side member 160, the central member 162, and the second side member 164 are all optionally formed as elongate tubular members having substantially square cross-sections, for example.

Figure 13:
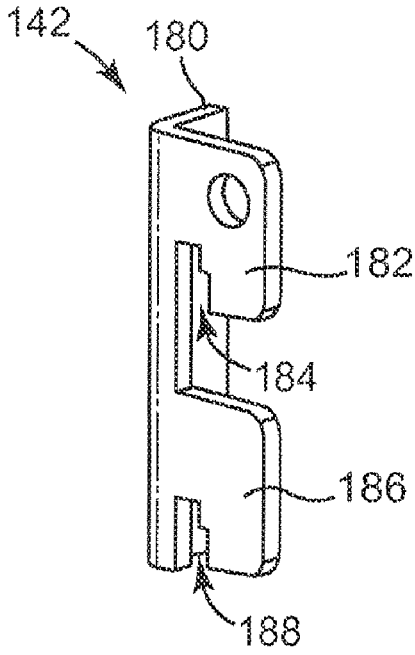
FIG. 13 is a perspective view of a first side vertical bracket, according to some embodiments.

FIG. 13 shows the first side vertical bracket 142 from a perspective view. With reference to FIG. 13, the central vertical bracket 144 and the second side vertical bracket 146 are optionally substantially similar to the first side vertical bracket 142, and as such, are described cumulatively with reference to the first side vertical bracket 142. The first side vertical bracket 142 includes a flange 180, an upper projection 182, or L-shaped protrusion, defining a mouth 184, or receptacle, and a lower projection 186, or L-shaped protrusion, defining a mouth 188, or receptacle. Each of the upper and lower projections 182, 186 is adapted to be inserted into the plurality of slots 35 (FIG. 4) of the first outer member 34 (FIG. 4) of the convertible fixture 22 (FIG. 4). In particular, the upper and lower projections 182, 186 are insertable into respective ones of the plurality of slots 35 with the mouths 184, 188 receiving portions of the first outer member 34 proximate the slots 35.

With reference to FIG. 11, it should be understood that each of the first side vertical bracket 142, the central vertical bracket 144, and the second side vertical bracket 146 is secured to the distal portions 166, 168, 170 of the members 160, 162, 164, respectively, for example via welding.

In this manner, the first side vertical bracket 142 is optionally releasably, yet securely maintained on the first outer member 34 (FIG. 4) by inserting portions of the projections 182, 186 into respective slots 35 and lowering the projections 182, 186 onto portions of the outer member 34 surrounding the slots 35 (FIG. 4). The central vertical bracket 144 and the second side vertical bracket 146 are similarly releasably secured to the central member 36 and the second outer member 38 of the convertible fixture 22 using the pluralities of slots 37, 39 (FIG. 4), respectively.

Figure 14:
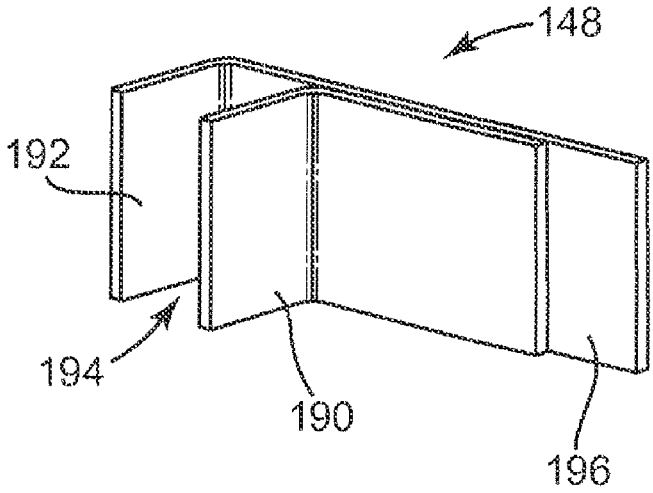
FIG. 14 is a perspective view of a lateral bracket, according to some embodiments.

FIG. 14 shows the lateral bracket 148 from a perspective view. With reference to FIG. 14, the lateral bracket 148 includes a first support clip 190 and a second support clip 192. Assembly of the first and second support clips 190, 192 results a combination forming a mouth 194, or receptacle, and an attachment base 196. The mouth 194 is optionally adapted to receive a top cross member of the second merchandise extender 24B, which is substantially similar to the top cross member 154 of the first merchandise extender 24A. The attachment base 196 is adapted to be secured centrally onto the top cross member 154 with the lateral bracket 148 projecting outwardly backward from the first merchandise extender 24A and with the mouth 194 of the lateral bracket 148 facing downwardly.

With reference between FIGS. 4 and 11, a method of assembling the first merchandise extender 24A to the convertible fixture 22 of the display system 20 includes securing the first side vertical bracket 142 to the first outer member 34 of the convertible fixture 22 using the plurality of slots 35 of the first outer member 34. In turn, the central vertical bracket 144 of the first merchandise extender 24A is attached to the central member 36 using the plurality of slots 37. Additionally, the second vertical bracket 146 is secured to the second outer member 38 using the plurality of slots 39. In particular, each of the vertical brackets 142, 144, and 146 is optionally inserted into pairs of the slots 35, 37, 39 and pressed downwardly to "clip" the vertical brackets 142, 144, 146 in place.

In this manner, the first merchandise extender 24A is optionally secured to the convertible fixture 22 at a desired height according to which of the pluralities of slots 35, 37, 39 the first merchandise extender 24A is secured. If desired, the second merchandise extender 24B (FIG. 12) is optionally secured to the convertible fixture 22 opposite the first merchandise extender 24A in a substantially similar manner using pluralities of slots formed in the convertible fixture 22 opposite the pluralities of slots 35, 37, 39, for example.

With reference to FIG. 2, the lateral bracket 148 of the first merchandise extender 24A is optionally attached to the second merchandise extender 24B, for example, by sliding the mouth 194 (FIG. 11) of the lateral bracket 148 over a top cross member of the second merchandise extender 24B. In some embodiments, the second merchandise extender 24B is characterized by the absence of a lateral bracket corresponding to the lateral bracket 148 in order to avoid interference with the lateral bracket 148 of the first merchandise extender 24B. However, the use of multiple lateral brackets, for example similar to the lateral bracket 148, to secure the first and second merchandise extenders 24A, 24B together is also contemplated. Using this dual-construction configuration, with the first and second merchandise extenders 24A, 24B secured top-to-top, provides structural support while retaining freedom to select a variety of configurations for the system 20.

Figure 3:
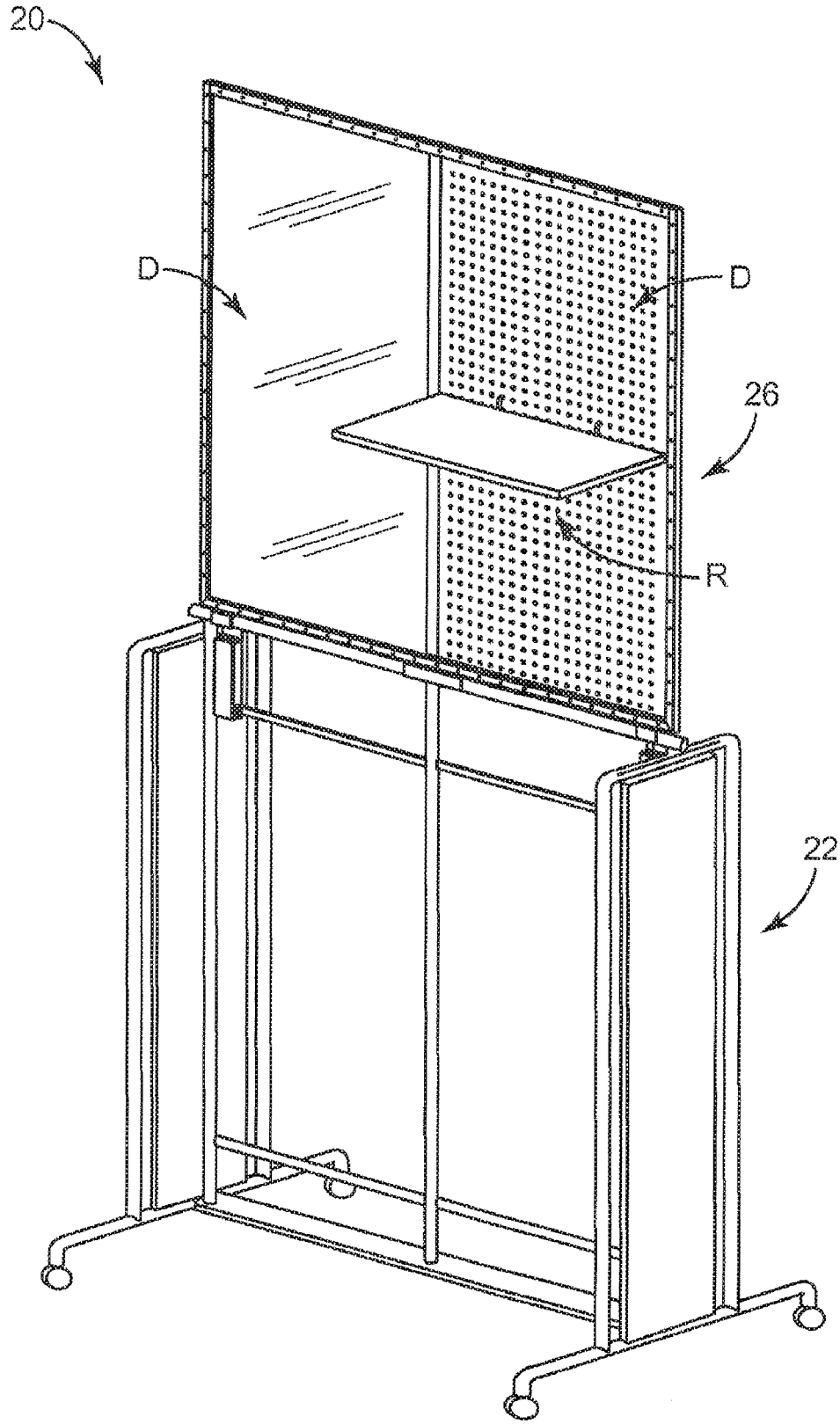

With reference to between FIGS. 1, 2, and 3, it should be understood that a variety of configurations of the system 20 are contemplated. For example, it should also be understood that the first and/or second merchandise extenders 24A, 24B and the billboard attachment 26 are optionally assembled to the convertible fixture 22, with the first and second merchandise extenders 24A, 24B sandwiching the billboard attachment 26. In other words, the billboard attachment 26 optionally extends vertically above the convertible fixture 22 between the first merchandise extender 24A and the second merchandise extender 24B according to some configurations of the display system 20.

The various configurations of the display system 20 provide a diverse variety of merchandising displays. With reference to FIGS. 1 and 2, one or both of the merchandise extenders 24A, 24B optionally has one or more merchandise support pieces R, such as a rack extender as shown, attached to the top cross member 154, the rack extender configured to maintain hangers holding articles of clothing such as shirts on hangers, for example. With reference to FIG. 1, a portion of a display piece D maintained by the billboard attachment 26 is optionally viewable through one or both of the first and second windows 150, 152 of the first merchandise extender 24A and the second merchandise extender 24B as shown.

To further illustrate the variety of potential merchandising configurations using the system 20, FIG. 3 shows the billboard attachment 26 supporting a display piece D that is an insert of pegboard material or other appropriate material into half of the frame 40 of the billboard attachment 26. One or more shelves or other merchandise supports are then optionally attached to the pegboard material to display/store merchandise. If desired, a second half of the frame 40 optionally maintains a billboard illustrating a slogan or interesting graphics, for example. If desired, a plurality of shelves (not shown) or other merchandise supports are optionally attached to the convertible fixture 22 using the pluralities of slots 35, 37, 39, for example, the merchandise supports maintaining such merchandise as a plurality of jeans or pants, for example. From the above, it should be apparent that a variety of configurations are contemplated using one or both of the merchandise extenders 24A, 24B and/or the billboard attachment 26.

Figure 15:
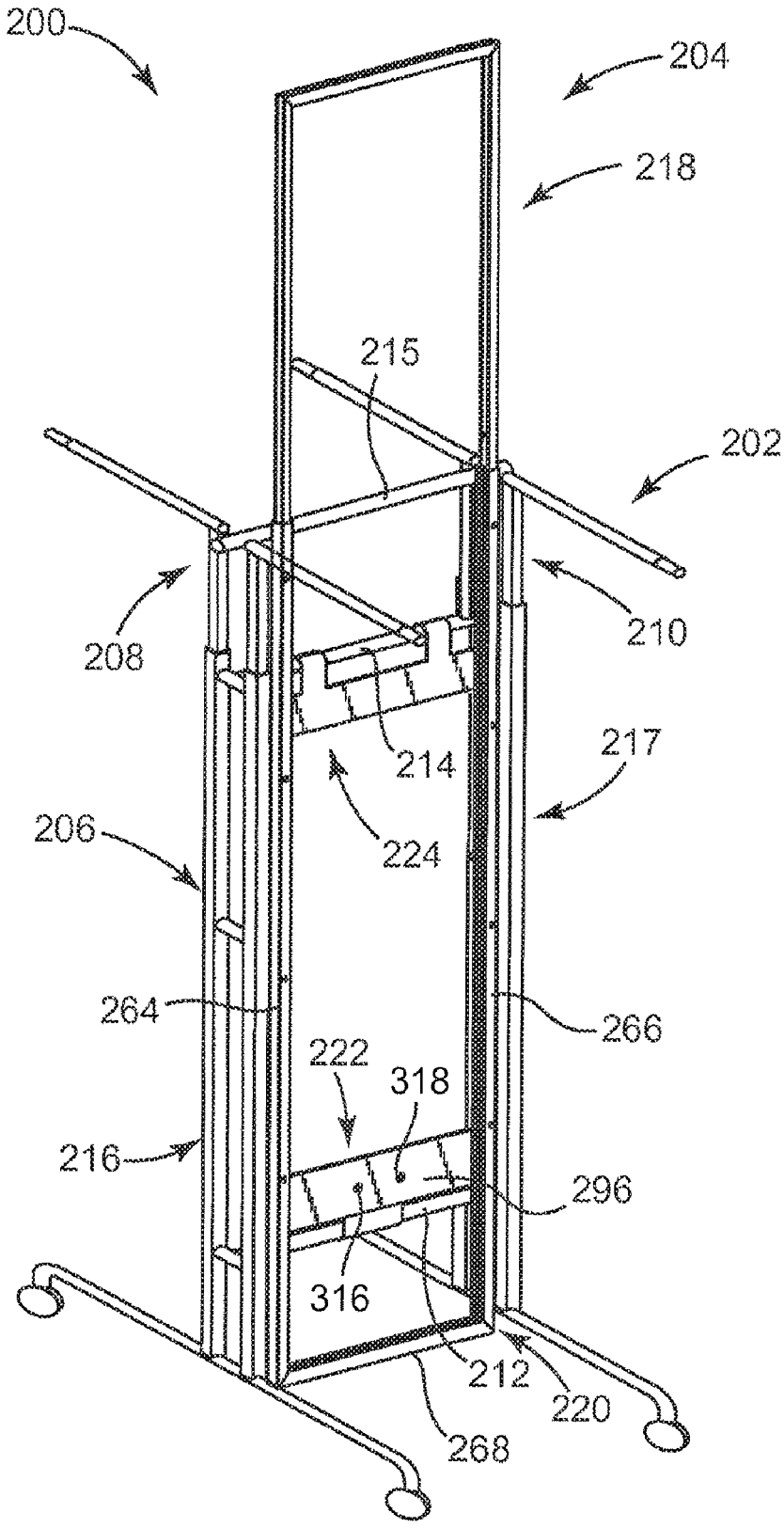
FIG. 15 is a perspective view of another display system, according to some embodiments.

FIG. 15 illustrates another display system 200 from a perspective view, also described as a racking system, a merchandising system, a rack fixture assembly, or a merchandising display. The display system 200 includes a quad-rack fixture 202, also described as a base rack, a base fixture, or a display fixture, and an extendable frame assembly 204, also described as an extendable billboard attachment, billboard attachment, or a billboard extender. In general terms, the extendable frame assembly 204 and associated structures are "accessories" to a display fixture, such as the quad-rack fixture 202, where the extendable frame assembly 204 is adapted to be extendable to receive display pieces, such as signs, or other pieces such as those previously described.

The quad-rack fixture 202 includes a frame 206, a first extendable arm assembly 208, and a second extendable arm assembly 210. The extendable arm assemblies 208, 210 are optionally adapted for supporting or otherwise maintaining clothes, hangers, etc. The frame 206 includes a lower cross member 212, an intermediate cross member 214, and a top cross member 215. The quad rack fixture 202 includes a first end piece 216 and a second end piece 217, the first and second end pieces 216, 217 adapted to support the quad rack fixture 202 on a surface (not shown). The quad-rack fixture 202 is adapted for displaying merchandise, for example clothing maintained on hangers.

The extendable frame assembly 204 includes a telescoping frame 218, a base frame 220, a lower clip assembly 222, and an upper clip assembly 224.

Figure 16A:
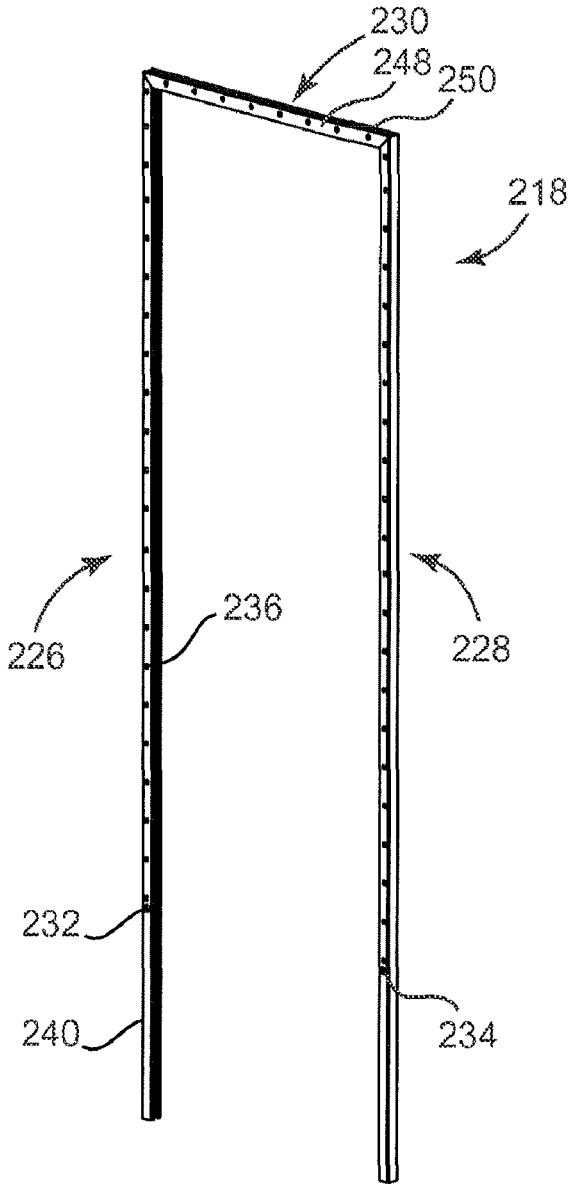
FIGS. 16A and 16B are perspective and top views, respectively, of a telescoping frame of the display system of FIG. 15, according to some embodiments.
Figure 16B:
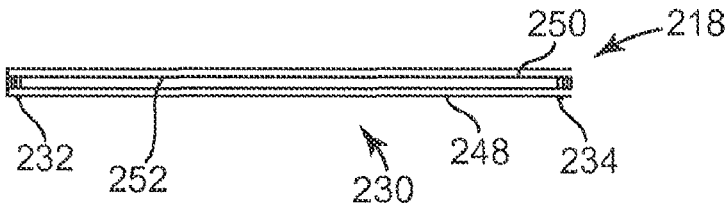

FIGS. 16A and 16B are perspective and top views, respectively, of the telescoping frame 218. The telescoping frame 218 includes a first vertical slide member 226, a second vertical slide member 228, a horizontal frame member 230, a first push button 232, and a second push button 234 and defines a plurality of spaced-apart holes 236 extending through the telescoping frame 218. The plurality of spaced-apart holes 236 are optionally substantially similar to the plurality of holes 88, for example, serving to assist in securing a display piece to the telescoping frame 218 as desired. However, it should be noted that the plurality of holes 236 are optionally used for a variety of purposes.

Figure 17A:
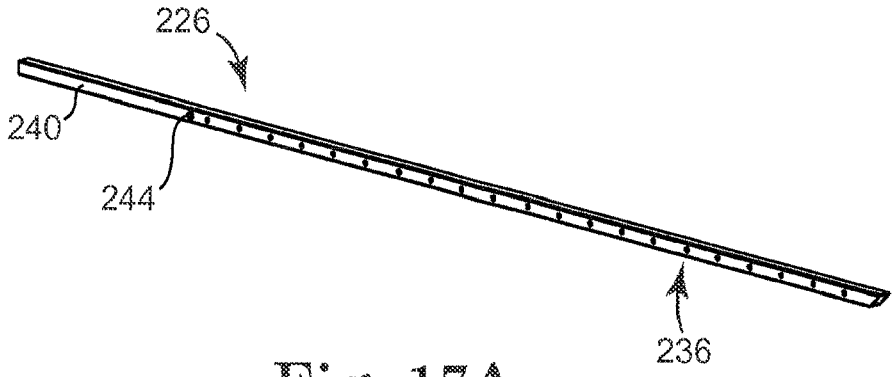
FIGS. 17A and 17B are perspective and end views, respectively, of a vertical slide member of the telescoping frame of FIGS. 16A and 16B, according to some embodiments.
Figure 17B:
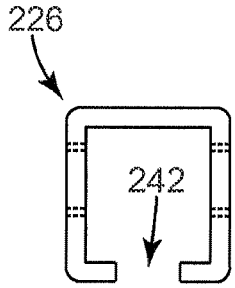

FIGS. 17A and 17B show the first vertical slide member 226 from perspective and end views, respectively. The second vertical slide member 228 is optionally substantially similar to the first vertical slide member 226, and as such, is described cumulatively with reference to the first vertical slide member 226. The first vertical slide member 226 is formed as a substantially hollow, elongate tubular member and defines a distal portion 240. In transverse cross-section, the first vertical slide member 226 is substantially square and C-shaped with a gap 242 running lengthwise along the first vertical slide member 226. The gap 242 is adapted to receive a portion of a display piece D, including those previously described, such as an edge of a billboard or other sign, for example. The first vertical slide member 226 also defines a button hole 244 in the distal portion 240, the button hole 244 adapted to receive a portion of the first push button 232 (shown in greater detail in FIG. 19).

With reference to FIGS. 16A and 16B, the horizontal frame member 230 includes a first band 248 and a second band 250, with the first band 248 located in front of the second band 250. The first band 248 optionally extends substantially parallel to the second band 250 in an opposing fashion.

Figure 18:
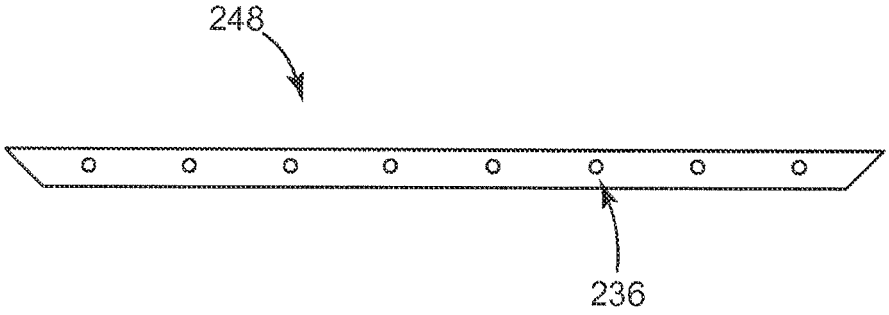
FIG. 18 is a front view of a first band of the telescoping frame of FIGS. 16A and 16B, according to some embodiments.

FIG. 18 shows the first band 248 from a perspective view. The first band 248 and the second band 250 are optionally substantially similar, and as such are described cumulatively with respect to the first band 248. The first band 248 is formed as a substantially elongate and thin-walled member having a substantially rectangular transverse cross-section. For reference, the first band 248 defines at least some of the plurality of spaced apart holes 236. Upon assembly, the combination of the first and second bands 248, 250 optionally defines a gap 252 (shown in more detail in FIG. 16B) in the horizontal frame member 230. The gap 252 is optionally adapted to receive a portion of a display piece D, such as those previously described. In this manner, a display piece D is optionally slid vertically downward between the first and second bands 248, 250 into the extendable frame assembly 204 (FIG. 15).

Figure 19:
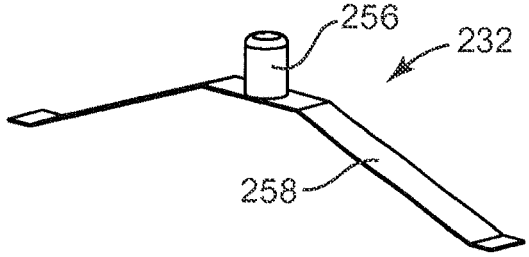
FIG. 19 is a perspective view of a push button of the telescoping frame of FIGS. 16A and 16B, according to some embodiments.

FIG. 19 shows the first push button 232 from a perspective view. The second push button 234 is optionally substantially similar to the first push button 232, and as such is described cumulatively with reference to the first push button 232. The first push button 232 includes a button 256 and a spring 258. The first push button 232 is adapted to be deflected via the spring 258 to actuate or depress the button 256 in an elastic "in-and-out" manner. The first push button 232 is secured inside of the first vertical slide member 226 with the button in the button hole 244 such that the button 256 is deflectable inwardly into the button hole 244 with an external force and will then elastically spring outwardly upon removing the external force. The button 234 is optionally similarly disposed inside the second vertical slide member 228, operating similarly to the button 232.

With reference to FIG. 15, the base frame 220 includes a first vertical leg 264, a second vertical leg 266, and an end member 268 extending between the first and second vertical legs 264, 266.

Figure 20A:
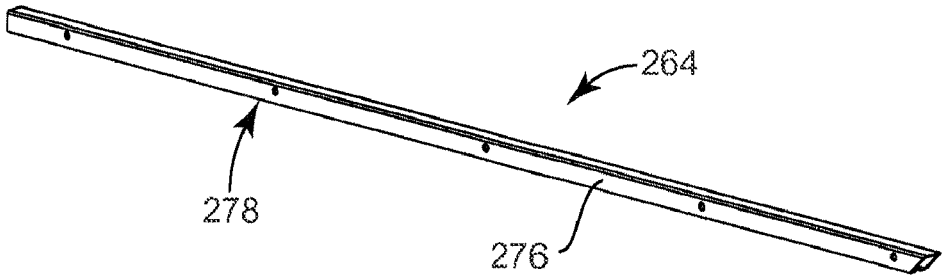
FIGS. 20A and 20B are perspective and end views, respectively, of a base frame vertical leg of the display system of FIG. 15, according to some embodiments.
Figure 20B:
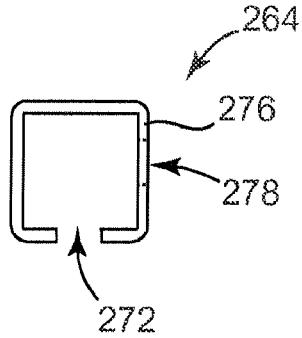

FIGS. 20A and 20B are perspective and end views, respectively, of the first vertical leg 264. The second vertical leg 266 is optionally substantially similar to the first vertical leg 264, and as such is described cumulatively with reference to the first vertical leg 264. The first vertical leg 264 is optionally formed as a substantially elongate, hollow, and tubular member. The first vertical leg 264 is also optionally substantially square and C-shaped in transverse cross-section with a gap 272 extending lengthwise along the first vertical leg 264. The gap 272 is optionally adapted to receive a portion of a display piece, for example, an edge of a poster, sign, billboard, pegboard, or other display piece.

The first vertical leg 264 also defines a front 276 with a plurality of adjustment holes 278 formed therethrough, the holes 278 being spaced out lengthwise along the first vertical leg 264. Each of the plurality of adjustment holes 278 is sized to receive the button 256 of the first push button 232. The plurality of adjustment holes 278 are spaced as desired, but in one embodiment are about 12.667 inches apart, for example, although other dimensions are contemplated. For reference, the second vertical leg 264 also optionally defines a plurality of adjustment holes for receiving the second push button 234.

Figure 21A:
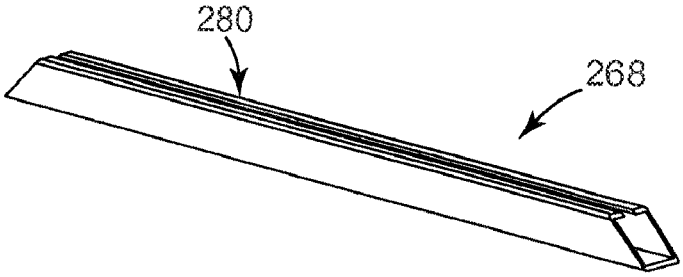
FIGS. 21A and 21B are perspective and end views, respectively, of a base frame end member of the display system of FIG. 15, according to some embodiments.
Figure 21B:
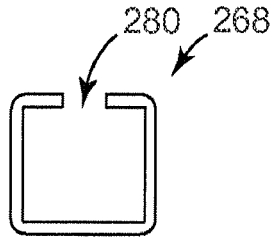

FIGS. 21A and 21B show the end member 268 from perspective and end views, respectively. The end member 268 is optionally an elongate, hollow, and tubular having a square, C-Shaped transverse cross-section with a gap 280 extending lengthwise along the end member 268. The gap 280 is optionally adapted to receive a portion of a display device D, such as those previously described.

With reference to FIG. 15, the base frame 220 is optionally assembled with the gap 272 (FIG. 20B) of the first vertical leg 264, a gap (not shown) of the second vertical leg 266, and the gap 280 (FIG. 21A) of the end member 268 facing inwardly and aligned to one another, with the two vertical legs 264, 266 positioned opposingly and secured to the end member 268. As discussed subsequently, each of the first and second vertical legs 264, 266 is adapted to slidably receive the telescoping frame 218. In turn, each of the first and second vertical slide members 226, 226 is adapted to be slidably received in the first and second vertical legs 264, 266, respectively.

Figure 22:
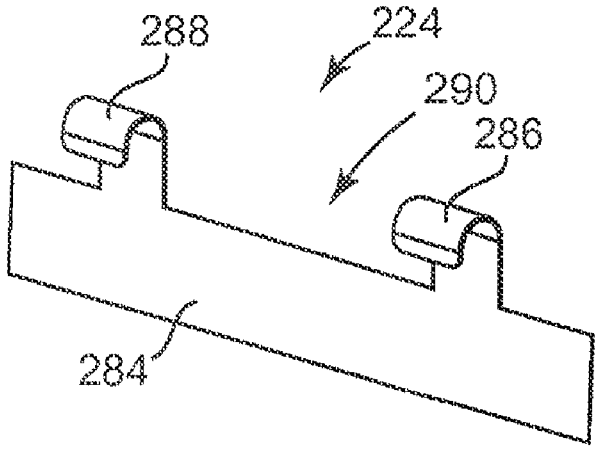
FIG. 22 is a perspective view of an upper clip assembly of the display system of FIG. 15, according to some embodiments.

FIG. 22 shows the upper clip assembly 224 from a perspective view. The upper clip assembly 224, also described as a first bracket, includes a base 284, a first hook portion 286, and a second hook portion 288. The first hook portion 286 and the second hook portion 288 are laterally spaced apart and define a gap 290 between the first and second hook portions 286, 288. The base 284 is a substantially rectangular and thin-walled plate adapted to be secured to the first and second vertical legs 264, 266 of the base frame 220. The first and second hook portions 286, 288 are each adapted to be releasably secured to the intermediate cross-member 214 (FIG. 15) of the quad-rack fixture 202 (FIG. 15), or otherwise hooked over the intermediate cross-member 214.

With reference to FIG. 15, upon assembly, the upper clip assembly 224 spans between the first and second vertical legs 264, 266 of the base frame 220 and is secured thereto, for example, via welds, with the first and second hook portions 286, 288 projecting in a direction opposite the end member 268.

Figure 23:
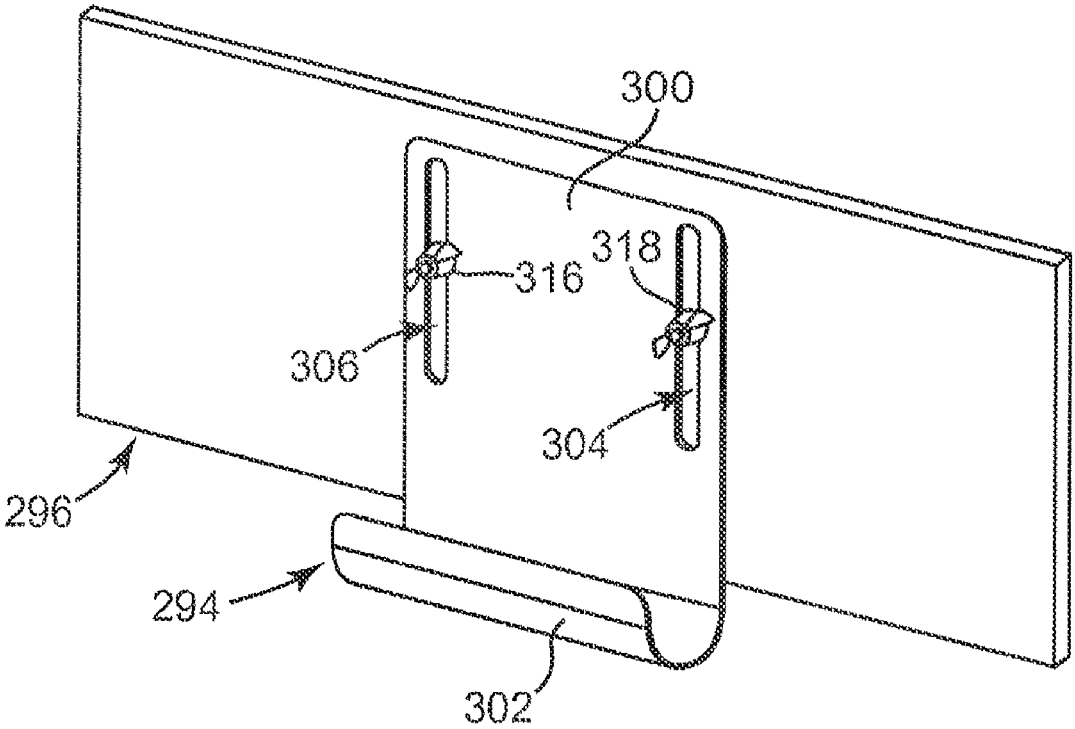
FIG. 23 is a perspective view of a lower clip assembly of the display system of FIG. 15, according to some embodiments.

FIG. 23 shows the lower clip assembly 222 from a perspective view, the lower clip assembly 222 also being described as a second bracket. The lower clip assembly 222 includes a clip 294 and a backing plate 296. The clip 294 includes a base portion 300 and a hook portion 302 and defines a first adjustment slot 304 and a second adjustment slot 306 in the base portion 300. As will be described in greater detail below, the first and second adjustment slots 304, 306 are optionally adapted to facilitate vertical adjustment of the clip 294. The hook portion 302 is adapted to releasably secure, retain, or otherwise be hooked to the lower cross member 212 of the quad-rack fixture 202. If desired, the hook portion defines a width that is complementary to the gap 290 of the upper clip assembly 224.

The backing plate 296 is formed as a thin-walled plate and includes a first fastener assembly 316, such as a bolt attached to the backing plate 296 and wing nut, and a second fastener assembly 318 optionally similar to the first fastener assembly 316. The first and second fastener assemblies 316, 318 are secured through the first and second slots 304, 306, respectively, of the clip 294. Upon loosening the first and second fastener assemblies 316, 318, for example by loosening corresponding wing nuts, the clip 294 is optionally slid up or down in relation to the backing plate 296. Once a desired position is located, the first and second fastener assemblies 316, 318 are then optionally tightened to secure the clip 294 in place.

In particular, the first and second adjustment slots 304, 306 of the clip 294 receive bolts, for example, of the first and second fastener assemblies 316, 318, respectively. The wing nut or other fastener is secured over each of the bolts to frictionally "snug up" or otherwise secure the clip 294 against the backing plate 296 with the hook portion 302 facing downwardly. Upon assembly, the backing plate 296 laterally spans the first and second vertical legs 264, 266 of the base frame 220 (FIG. 15), being secured therebetween, for example, via welding.

Figure 24:
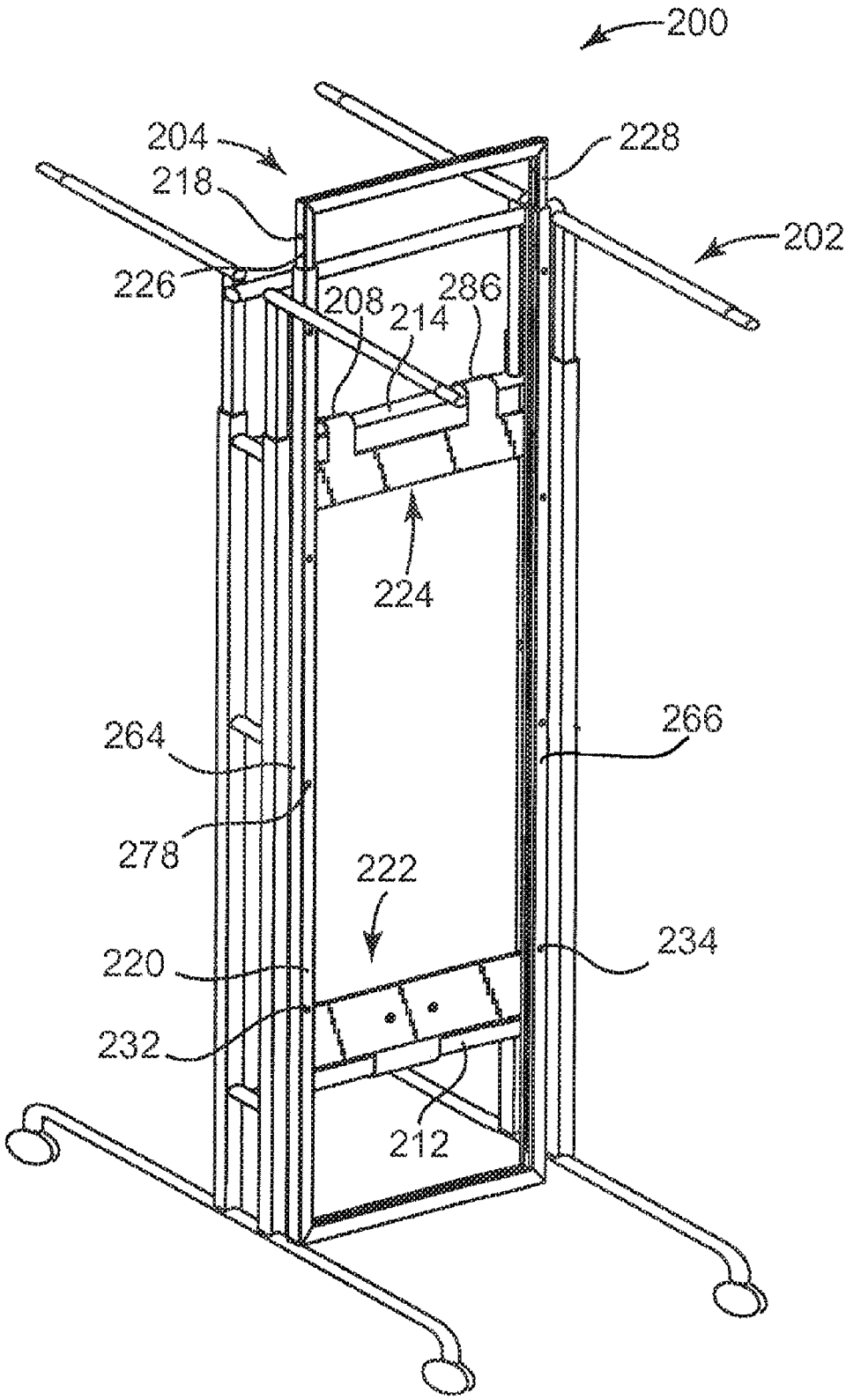
FIG. 24 is a perspective view of the display system of FIG. 15 in a second, smaller state of extension, according to some embodiments.

With reference to FIG. 24, the telescoping frame 218 is slidably received within the base frame 220 to allow height/size adjustment of the extendable frame assembly 204. In particular, the distal portion 240 (FIG. 16A) of the first vertical slide member 226 is inserted into the first vertical leg 264 and a distal portion of the second vertical slide member 228 is inserted into the second vertical leg 266 such that the telescoping frame 218 is slidable vertically relative to the base frame 220. With this arrangement, the gaps 272, 280 (FIGS. 20B and 21B) of the first vertical slide member 226 and the first vertical leg 264 are aligned. The second vertical slide member 228 and the second vertical leg 266 are similarly aligned.

The first and second push buttons 232, 234 optionally lock the telescoping frame 218 in a first "detent position" relative to the base frame 220 where the first and second push buttons 232, 234 protrude or otherwise push out through corresponding ones of the plurality of adjustment holes 278 of the base frame 220. The telescoping frame 218 is then optionally adjusted, or otherwise slid to another detent position by pushing inwardly on the first and second push buttons 232, 234, and sliding the telescoping frame 218 vertically relative to the base frame 220 until another pair of the plurality of adjustment holes 278 aligns to, and mates with, the first and second push buttons 232, 234, such that the push buttons 232, 234 are each secured in a respective one of the adjustment holes 278.

With reference to FIG. 24, one method of releasably securing the quad-rack fixture 202 and the extendable frame assembly 204 together to form the display system 200 includes loosening the lower clip assembly 222, moving the lower clip assembly 222 away from the first and second hook portions 286, 288 of the upper clip assembly 224 such that the upper and lower clip assemblies 222, 224 define an open, or release position. The upper clip assembly 224 is hooked, or otherwise secured over the intermediate cross member 214 of the quad-rack fixture 202. The lower clip assembly 222 is optionally slid toward the lower cross member 212 of the quad-rack fixture 202 and hooked over the lower cross member 212 such that the upper and lower clip assemblies 222, 224 define a closed, or secured position. The lower clip assembly 222 is optionally tightened, for example using wing nuts or other means as previously described to secure the lower clip assembly 222 in a relatively fixed position. The extendable frame assembly 204 is optionally removed from the quad-rack fixture 202 by releasing or loosening the lower clip assembly 222 and sliding the lower clip assembly 222 away from the upper clip assembly 224.

With reference between FIG. 15 and FIG. 24, it should be understood that the extendable frame assembly 204 optionally extends vertically above the quad-rack fixture 202 and is capable of receiving display pieces of various sizes and/or multiple display pieces. In particular, FIG. 15 illustrates the extendable frame assembly 204 in a first state of extension to define a first height or size and FIG. 24 illustrates the extendable frame assembly 204 in a second, smaller, or lesser, state of extension to define a second, smaller height or size. The extendable nature of the extendable frame assembly 204 allows adaptability of the extendable frame assembly 204 to a variety of heights/sizes to receive a variety of display pieces of varying heights. Thus, the extendable frame assembly 204 is optionally adapted to be adjusted to define a complementary size to that of a display piece D, such as a billboard, sign, pegboard, or other display piece D such as those previously described.

Furthermore, unique manners of displaying merchandise using multiple ones of the display system 200 are optionally accomplished. For example, one method of displaying includes using a plurality of the display systems 200 to create an "undulating height effect." A plurality of the display systems 200 are disposed in a variety of different arrangements, for example: spaced apart, one behind the other; spaced-apart, one next to the other; spaced-apart, kitty corner; or other spaced-apart or immediately-adjacent patterns or arrangements of the display systems 200. Heights of the racking systems 200 are optionally varied such that they undulate, for example in a substantially sinusoidal fashion. The systems 200 are also optionally configured at random varying heights, in a repeating pattern of varying heights, in a graduating pattern, for example shortest to tallest, and other patterns. In this manner, an observer viewing the plurality of display systems 200 from a particular viewpoint is presented with a pleasing visual effect according to the various heights and locations of the display systems 200 as desired.

From the above, it should be understood that embodiments of the display systems 20, 200 present various advantages including versatile, visually pleasing, and enhanced capacity merchandise displays. Although the invention has been described with respect to particular embodiments, such embodiments are for illustrative purposes only and should not be construed in a limiting sense. Various alternatives and changes will be apparent to those of ordinary skill in the art. For example, although disclosed above as being formed in a particular shape or with a particular size, other suitable shapes and sizes of display systems are also contemplated. Other modifications within the scope of the invention and its various embodiments will be apparent to those of ordinary skill.

What is claimed is:

1. A display system comprising:

a base fixture adapted to support merchandise in a retail environment, the base fixture comprising:

a first end piece and a second end piece positioned opposite the first end piece, the first and second end pieces being adapted to support the base fixture on a substantially horizontal surface, a first member extending substantially horizontally and substantially orthogonally between the first end piece and the second end piece, and a second member extending substantially horizontally and substantially orthogonally between the first end piece and the second end piece, the second member positioned below the first member; and a display fixture accessory comprising:

a frame that is substantially rectangular in shape and adapted to receive a display piece, a first clip secured to the frame, the first clip adapted to receive the first member, and a second clip secured to the frame, the second clip adapted to receive the second member;

wherein upon assembly the display fixture accessory is releasably secured to the base fixture in a substantially vertical position and is adapted to extend vertically with the first member releasably secured to the first clip and the second member releasably secured to the second clip.

2. The display system of claim 1, wherein the substantially rectangular frame of the display fixture accessory defines a bottom side, wherein the first and second clips are each secured to the bottom side of the frame at laterally spaced positions.

3. The display system of claim 1, wherein the first clip includes an upper portion and a lower portion, the upper portion defining a substantially L-shaped receptacle and the lower portion having first and second slots adapted to receive the second member.

4. The display system of claim 1, wherein the first and second clips are secured to the frame at vertically spaced positions.

5. The display system of claim 4, wherein the first clip includes a first hook portion and the second clip includes a second hook portion, and further wherein the second hook portion is substantially vertically movable relative to the first hook portion between a release position and a secure position, and further wherein the display fixture accessory is releasably secured to the base fixture when the second hook portion is in the secure position.

6. The display system of claim 1, wherein the frame of the display fixture accessory defines a height and comprises a base portion and a telescoping portion, and further wherein the telescoping portion is slidably received in the base portion such that the size of the frame is selectively adjustable.

7. The display system of claim 1, wherein the base fixture further comprises:

a first outer member and a second outer member, each of the first outer member and the second outer member extending substantially vertically and defining a plurality of slots;

wherein the display fixture system further comprises:

a first merchandise extender adapted to maintain merchandise, the first merchandise extender comprising:

a frame adapted to maintain a merchandise support piece, the frame including a first side leg and a second side leg, each of the first side leg and the second side leg extending substantially vertically;

a first bracket secured to the first side leg and a second bracket secured to the second side leg;

and further wherein the first bracket is releasably secured into the plurality of slots of the first outer member and the second bracket is secured to the second outer member such that the frame of the first merchandise extender is maintained in a substantially vertical position extending above the base fixture and in front of the display fixture accessory.

8. The display system of claim 7, further comprising:

a second merchandise extender adapted to maintain merchandise, the second merchandise extender comprising:

a frame adapted to maintain a merchandise support piece, the frame including a first side leg and a second side leg, the first side leg and the second side leg extending substantially vertically;

a first bracket secured to the first side leg and a second bracket secured to the second side leg;

wherein the first bracket of the second merchandise extender is releasably secured to the first outer member and the second bracket of the second merchandise extender is secured to the second outer member such that the frame of the second merchandise extender is maintained in a substantially vertical position extending above the base fixture and opposite to the first merchandise extender.

9. A display system comprising:

a base fixture adapted to support merchandise in a retail environment, the base fixture comprising:

a first end piece and a second end piece positioned opposite the first end piece, the first and second end pieces being adapted to support the base fixture on a substantially horizontal surface, a first member extending substantially horizontally and substantially orthogonally between the first end piece and the second end piece, and a second member extending substantially horizontally and substantially orthogonally between the first end piece and the second end piece, the second member positioned below the first member; and a display fixture accessory comprising:

a frame that is substantially rectangular in shape and adapted to receive a display piece, a first clip secured to the frame, the first clip adapted to receive the first member, and a second clip secured to the frame and spaced laterally from the first clip, the second clip adapted to receive the second member, wherein each of the first clip and the second clip includes an upper connecting portion and a lower connecting portion;

wherein upon assembly the display fixture accessory is releasably secured to the base fixture in a substantially vertical position and is adapted to extend vertically with the first member releasably secured in the upper connecting portions of both the first clip and the second clip, and the second member releasably secured in the lower connecting portions of both the first clip and the second clip.

10. The display system of claim 9, wherein the substantially rectangular frame of the display fixture accessory defines a bottom side, wherein the first and second clips are each secured to the bottom side of the frame at laterally spaced positions.

11. The display system of claim 9, wherein the first and second clips are secured to the frame at vertically spaced positions.

12. The display system of claim 11, wherein the first clip includes a first hook portion and the second clip includes a second hook portion, and further wherein the second hook portion is substantially vertically movable relative to the first hook portion between a release position and a secure position, and further wherein the display fixture accessory is releasably secured to the base fixture when the second hook portion is in the secure position.

13. The display system of claim 9, wherein the frame of the display fixture accessory defines a height and comprises a base portion and a telescoping portion, and further wherein the telescoping portion is slidably received in the base portion such that the size of the frame is selectively adjustable.

14. The display system of claim 9, wherein the base fixture further comprises:

a first outer member and a second outer member, each of the first outer member and the second outer member extending substantially vertically and defining a plurality of slots;

wherein the display fixture system further comprises:

a first merchandise extender adapted to maintain merchandise, the first merchandise extender comprising:

a frame adapted to maintain a merchandise support piece, the frame including a first side leg and a second side leg, each of the first side leg and the second side leg extending substantially vertically;

a first bracket secured to the first side leg and a second bracket secured to the second side leg;

and further wherein the first bracket is releasably secured into the plurality of slots of the first outer member and the second bracket is secured to the second outer member such that the frame of the first merchandise extender is maintained in a substantially vertical position extending above the base fixture and in front of the display fixture accessory.

15. The display system of claim 14, further comprising:

a second merchandise extender adapted to maintain merchandise, the second merchandise extender comprising:

a frame adapted to maintain a merchandise support piece, the frame including a first side leg and a second side leg, the first side leg and the second side leg extending substantially vertically;

a first bracket secured to the first side leg and a second bracket secured to the second side leg;

wherein the first bracket of the second merchandise extender is releasably secured to the first outer member and the second bracket of the second merchandise extender is secured to the second outer member such that the frame of the second merchandise extender is maintained in a substantially vertical position extending above the base fixture and opposite to the first merchandise extender.

16. A merchandising system comprising:

a display fixture including a first end piece, a second end piece, a first member, and a second member, each of the first member and the second member being substantially horizontal with the second member extending substantially parallel to, and vertically offset from the first member;

a display fixture accessory releasably secured to the display fixture, the display fixture accessory including a first clip and a second clip spaced laterally from the first clip, each of the first clip and the second clip including an upper connecting portion and a lower connecting portion, wherein the first member is received in the upper connecting portions of both the first clip and the second clip, and wherein the second member is received in the lower connecting portions of both the first clip and the second clip; and a display piece inserted into the display fixture accessory.

17. The merchandising system of claim 16, wherein the display piece is maintained with the display fixture accessory in a substantially vertical position with the display fixture accessory extending above the display fixture.

18. The merchandising system of claim 16, wherein the upper connecting portion of at least the first clip defines a substantially L-shaped receptacle and the lower connecting portion defines first and second slots adapted to receive the second member, the first clip being engaged with the first member such that the first member is received in the L-shaped receptacle, and the second member being received in the first and second slots of the lower connecting portion.

19. The merchandising system of claim 16, wherein the first clip includes a first hook portion and second clip includes a second hook portion, the first and second hook portions being disposed in a substantially vertically opposing fashion, wherein the first hook portion is secured over the first member and the second hook portion is secured under the second member.

20. The merchandising system of claim 16, wherein the display fixture accessory includes a frame for holding a display piece, the frame defining an overall height, wherein the overall height of the frame is adjustable from a first height to a second, larger height.

* * * * *